US007348302B2

(12) United States Patent
Smith

(10) Patent No.: US 7,348,302 B2
(45) Date of Patent: Mar. 25, 2008

(54) FOAM CLEANING AND BRIGHTENING COMPOSITION COMPRISING A SULFATE/BISULFATE SALT MIXTURE

(75) Inventor: Kim R. Smith, Woodbury, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 11/268,287

(22) Filed: Nov. 4, 2005

(65) Prior Publication Data

US 2006/0100119 A1 May 11, 2006

Related U.S. Application Data

(60) Provisional application No. 60/626,261, filed on Nov. 8, 2004.

(51) Int. Cl.
*C11D 7/10* (2006.01)
*C11D 3/43* (2006.01)
*C11D 1/66* (2006.01)

(52) U.S. Cl. ..... 510/254; 510/189; 510/202; 510/209; 510/245; 510/269; 510/356; 510/370; 510/406; 510/432

(58) Field of Classification Search ..... 510/189, 510/202, 209, 254, 245, 269, 356, 370, 406, 510/432
See application file for complete search history.

(56) References Cited

U.S. PATENT DOCUMENTS 3,721,629 A * 3/1973 Goodenough ..... 510/363
3,931,673 A 1/1976 Eggemann
3,969,135 A 7/1976 King et al.
3,979,042 A 9/1976 Peters
3,988,254 A 10/1976 Mori
4,013,492 A 3/1977 Rager et al.
4,021,360 A * 5/1977 McLaughlin et al. ..... 510/229
4,033,894 A * 7/1977 McLaughlin et al. ..... 510/220
4,154,578 A 5/1979 Bane
4,197,359 A 4/1980 Rager et al.
4,199,624 A 4/1980 Smith
4,242,215 A * 12/1980 Smid et al. ..... 510/309
4,244,079 A 1/1981 Bane
4,314,876 A 2/1982 Kremer et al.
4,348,294 A 9/1982 King
RE31,198 E 4/1983 Binns
4,472,205 A 9/1984 Cortner
4,477,290 A 10/1984 Carroll et al.
4,496,465 A 1/1985 Whitehurst et al.
4,496,466 A 1/1985 Whitehurst et al.
4,530,735 A 7/1985 Whitehurst et al.
4,532,065 A 7/1985 Cohen et al.
4,540,444 A 9/1985 Kelly
4,566,173 A 1/1986 Gössler et al.
4,585,519 A 4/1986 Jaffe et al.
4,613,449 A 9/1986 Dingess
4,678,597 A 7/1987 Kiener
4,684,281 A 8/1987 Patterson
4,692,349 A 9/1987 Georgiou et al.
RE32,661 E 5/1988 Binns
4,762,638 A 8/1988 Dollman et al.
4,778,533 A 10/1988 Gregory et al.
4,781,854 A * 11/1988 Overton et al. ..... 510/372
4,787,999 A 11/1988 Dingess
4,812,240 A 3/1989 Watts
4,857,225 A 8/1989 Terada et al.
4,940,493 A 7/1990 Neidiffer et al.
4,959,105 A 9/1990 Neidiffer et al.
4,970,014 A 11/1990 Garcia
5,084,131 A 1/1992 Inoue et al.
5,134,093 A 7/1992 Onishi et al.
5,158,694 A 10/1992 Waynick
5,239,403 A 8/1993 Shiraishi et al.
5,259,960 A 11/1993 Beck et al.
5,380,468 A 1/1995 Gober et al.
5,389,305 A * 2/1995 Repinec et al. ..... 510/237
5,401,334 A 3/1995 O'Melia et al.
5,435,899 A 7/1995 Gimenez et al.
5,441,572 A 8/1995 Rodzewich
5,464,484 A 11/1995 Rodzewich
5,472,512 A 12/1995 Gober et al.
5,472,630 A 12/1995 Ouyang et al.
5,474,184 A * 12/1995 Mandler et al. ..... 206/519
5,478,414 A 12/1995 Mozelewski et al.
5,531,841 A 7/1996 O'Melia et al.
5,545,347 A 8/1996 Ouyang et al.
5,552,172 A 9/1996 Liebermann
5,554,686 A 9/1996 Frisch, Jr. et al.

(Continued)

*Primary Examiner*—Charles Boyer
(74) *Attorney, Agent, or Firm*—Andrew D. Sorensen; Anneliese S. Mayer

(57) ABSTRACT

A cleaning composition including a metal bisulfate and metal inorganic salt acid package, and at least one surfactant. The cleaning composition can be a one-step wheel cleaner/brightener. The composition preferably contains no HF, no bifluoride, no oxalic acid, or other poisonous and highly toxic materials commonly found in both industrial and consumer wheel cleaners. Further, the wheel cleaner/brightener composition matches or exceeds the performance of those hazardous formulations and does not damage aluminum wheels even when applied to hot metal. The composition can be a foam composition, provided in a foam dispenser. The foam dispenser includes a container and a mechanical foaming head. The container includes a cleaning composition containing a metal bisulfate and metal sulfate acid package, and at least one surfactant, water, and a foam-boosting solvent.

23 Claims, 4 Drawing Sheets

U.S. PATENT DOCUMENTS 5,569,478 A 10/1996 Liebermann
5,570,625 A 11/1996 Liebermann
5,571,336 A 11/1996 Wurzburger et al.
5,622,569 A 4/1997 Dennis et al.
5,637,404 A 6/1997 Bombalski et al.
5,655,434 A 8/1997 Liebermann
5,681,487 A 10/1997 Seki et al.
5,701,804 A 12/1997 Liebermann
5,716,657 A 2/1998 Liebermann
5,753,304 A 5/1998 Tung
5,755,992 A 5/1998 Jeffrey et al.
5,786,315 A * 7/1998 Sadlowski ..... 510/230
5,855,805 A * 1/1999 Arabinick ..... 216/106
5,879,816 A 3/1999 Mori et al.
5,895,781 A * 4/1999 Neumiller et al. ..... 510/238
5,958,858 A 9/1999 Bettiol et al.
5,965,505 A 10/1999 Baillely et al.
6,008,181 A 12/1999 Cripe et al.
6,015,781 A 1/2000 Vinson et al.
6,018,724 A 1/2000 Arent
6,020,303 A 2/2000 Cripe et al.
6,046,149 A 4/2000 Sorrie et al.
6,046,295 A 4/2000 Frisch, Jr. et al.
6,060,443 A 5/2000 Cripe et al.
6,093,856 A 7/2000 Cripe et al.
6,129,262 A 10/2000 Cooper et al.
6,133,222 A 10/2000 Vinson et al.
6,143,637 A 11/2000 Yagi
6,153,577 A 11/2000 Cripe et al.
6,162,926 A 12/2000 Murphy et al.
6,197,733 B1 3/2001 Mikami et al.
6,218,351 B1 4/2001 Busch et al.
6,228,829 B1 5/2001 Vinson et al.
6,232,027 B1 5/2001 Matsunaga et al.
6,242,406 B1 6/2001 Katsuda et al.
6,306,812 B1 10/2001 Perkins et al.
6,326,348 B1 12/2001 Vinson et al.
6,328,041 B1 12/2001 Brown et al.
6,339,054 B1 1/2002 Levitt et al.
6,386,778 B1 5/2002 Guay et al.
6,387,862 B2 5/2002 Busch et al.
6,399,152 B1 6/2002 Goodrich
6,399,557 B2 6/2002 Perkins et al.
6,399,785 B1 6/2002 Murphy et al.
6,400,905 B1 6/2002 Tenmyo
6,440,224 B1 8/2002 Wei et al.
6,448,213 B1 9/2002 Willman
6,448,412 B1 9/2002 Murphy et al.
6,489,281 B1 12/2002 Smith et al.
6,534,472 B1 * 3/2003 Arvanitidou et al. ..... 510/438
6,559,113 B2 5/2003 Jeffrey et al.
6,566,318 B2 5/2003 Perkins et al.
6,579,377 B2 6/2003 Wei et al.
6,608,015 B2 8/2003 Busch et al.
6,610,844 B2 8/2003 Ng et al.
6,626,402 B1 9/2003 Kaminstein
6,641,977 B2 11/2003 Oohashi
6,645,858 B2 11/2003 Pyo et al.
6,663,902 B1 * 12/2003 Hei et al. ..... 424/661
6,678,913 B1 1/2004 Wayne
6,692,722 B2 2/2004 Ando et al.
6,741,086 B2 5/2004 Maekawa et al.
6,753,080 B1 6/2004 Sebastian et al.
6,800,190 B1 10/2004 Wilcox et al.
2002/0173442 A1 * 11/2002 Smith et al. ..... 510/438
2003/0199077 A1 * 10/2003 Fano et al. ..... 435/263

* cited by examiner

FOAM CLEANING AND BRIGHTENING COMPOSITION COMPRISING A SULFATE/BISULFATE SALT MIXTURE

This application claims priority under 35 U.S.C. § 119(e) to U.S. provisional application Ser. No. 60/626,261, filed Nov. 8, 2004 and entitled "Foam Cleaning and Brightening Composition". The entire disclosure of 60/626,261 is incorporated herein by reference.

FIELD OF THE INVENTION

The present invention relates to a cleaning composition and methods of making the composition, and methods of using the composition to clean surfaces, particularly metal surfaces.

BACKGROUND

There is a desire in today's market, particularly the automobile market, to be able to obtain clean and bright metal surfaces. This is particularly desired for automobile and other vehicle wheels, where aluminum wheels are very common. Various metal cleaners are commercially available for cleaning and polishing of aluminum wheels, however many of these have flaws. For example, some do not provide adequate levels of cleaning, some do not provide an adequately brightened aluminum surface, some may damage or mar the metal surface, and some may be hazardous to the user's health after prolonged exposure. Wheel cleaners containing HF (hydrofluoric acid), oxalic acid or phosphates are common, but have at least one of these deficiencies.

A better metal cleaner is desired, especially one for cleaning and brightening aluminum surfaces.

SUMMARY OF THE INVENTION

Figure 1:
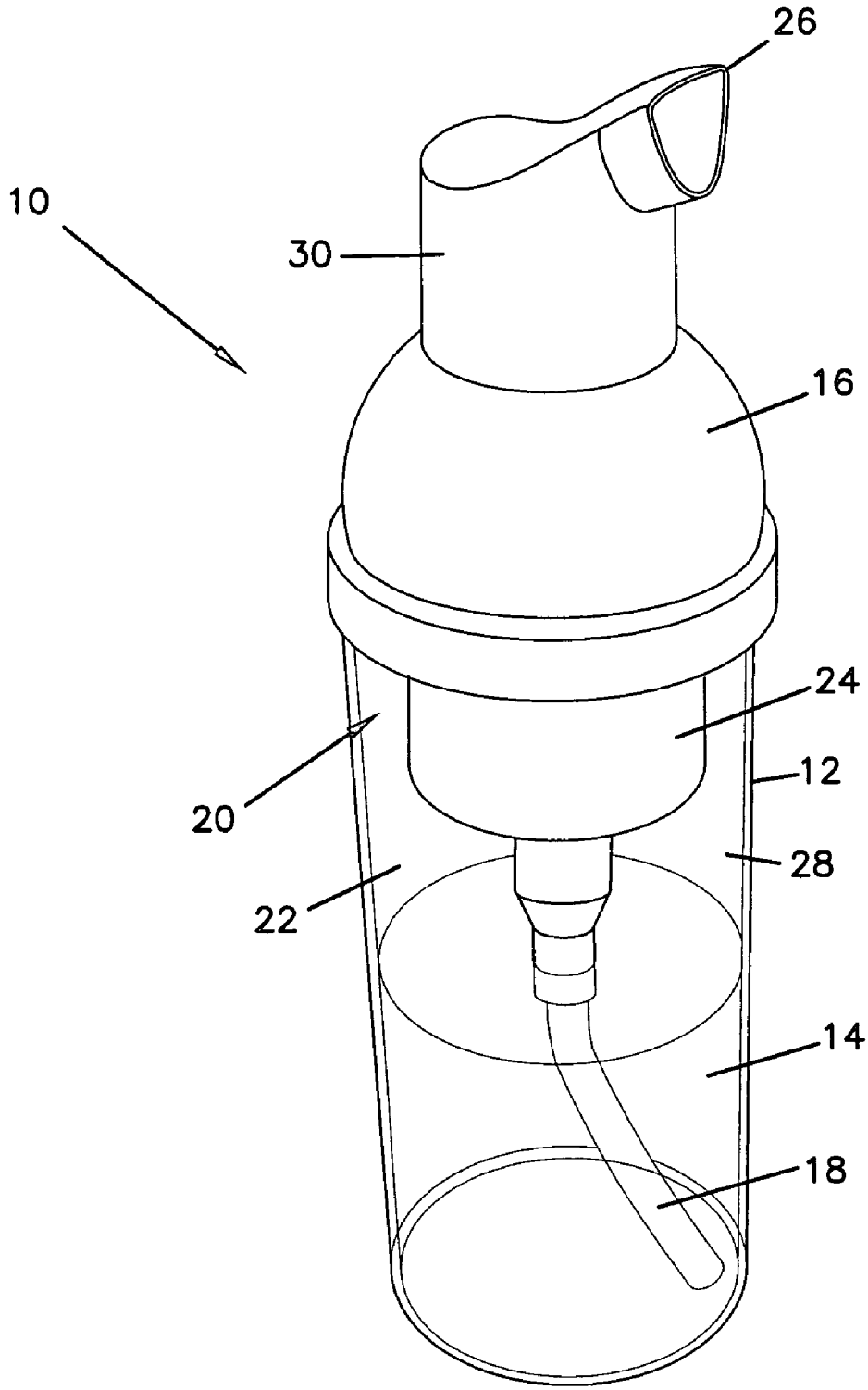
FIG. 1 is a perspective view of a foam dispenser suitable for use with the composition of the invention.

The present invention is directed to a composition, particularly a cleaning composition. The cleaning composition includes an acid package and at least one surfactant. When used on metal surfaces, the acid package provide brightening and the surfactant provides cleaning.

The acid package includes a bisulfate and an inorganic salt, the inorganic salt being acidic or neutral pH when by itself. The inorganic salt provides buffering to the bisulfate. Typically, the bisulfate and salts are metal bisulfates and inorganic metal salts. Suitable inorganic salts for the acid package include chloride, phosphate, carbonate, and sulfate, including sodium chloride, potassium phosphate, calcium carbonate, and magnesium sulfate. A preferred acid package includes bisulfate and sulfate salts, such as sodium bisulfate and sodium sulfate.

The surfactant can include anionic surfactants, cationic surfactants, nonionic surfactants, and zwitterionic or amphoteric surfactants. A preferred class of anionic surfactant to use is sulfonates, such as alkyl sulfonates and aryl sulfonates. One preferred cationic surfactant to use is a quaternary ammonium compound.

In a preferred embodiment, the present invention is a composition that is a one-step wheel cleaner/brightener, and the invention includes methods of dispensing and using the composition. The composition of the invention contains no HF, no bifluoride, no oxalic acid, or other poisonous and highly toxic materials commonly found in both industrial and consumer wheel cleaners. Further, the wheel cleaner/brightener composition matches or exceeds the performance of those hazardous formulations and does not damage aluminum wheels even when applied to hot metal. Additionally, the composition has the added benefit of providing a one-step metal cleaning and brightening, especially aluminum.

The composition can be a foam composition, provided in a foam dispenser. The foam dispenser includes a container and a mechanical foaming head. The container includes a cleaning composition containing a metal bisulfate and inorganic metal salt acid package, and at least one surfactant, water, and a foam-boosting solvent. Glycol ether is a preferred foam-boosting solvent.

A method for foaming a cleaning composition is provided according to the invention. The method includes steps of mixing a cleaning composition and air in a mechanical foaming head to provide mixing of the cleaning composition and air to generate a foam.

DETAILED DESCRIPTION OF THE INVENTION

The present invention is a cleaning composition and methods of making the composition, and methods of using the composition to clean surfaces, particularly metal surfaces. Aluminum is one exemplary metal that can be cleaned and brightened with the composition. The cleaning composition is provided so that it foams as a result of processing through a mechanical foaming head as a result of combining the cleaning composition with air without the use of an aerosol propellant.

The composition can be referred to as a cleaning composition or a detergent composition and can be provided in the form of a concentrated composition, a ready-to-use composition, and/or a use composition. The phrase "cleaning composition" refers to a composition that provides for the removal of a substance from a surface to be cleaned. Exemplary substances that can be removed by the cleaning composition include general materials such as soil, dirt, oil and grease, and more specific materials such as road grime, road salt, brake dust, and other common materials.

The cleaning composition of the present invention can be used to clean vehicle components. Materials such as road grime, road salt and brake dust are commonly found on automobile wheels and rims, but are also found on other vehicles and vehicle surfaces, such as trailers, campers, semi-trucks, airplanes, and the like. The cleaning composition of the present invention can additionally or alternatively be used on small scale-surfaces such as countertops, cabinetry, appliances, and other institutional or industrial surface applications, or large-scale surfaces such as storage tanks, reaction tanks, process equipment such as fermentors, and other such institutional or industrial surface applications.

The concentrated composition can be referred to as a concentrate, and can be diluted to provide the ready-to-use composition and/or the use composition. The concentrate can be diluted in a single dilution or in stages to provide the ready-to-use composition and/or the use composition. Providing the cleaning composition as a concentrate for subsequent dilution can be advantageous when it is desirable to package and ship the concentrate instead of the ready-to-use cleaning composition and/or the use composition. The ready-to-use composition can be made available as a use composition when the ready-to-use composition is intended to be applied directly to a surface to provide cleaning. For example, a wheel cleaner can be referred to as a ready-to-use composition when it is intended to be applied directly to a wheel surface for cleaning.

Cleaning Composition

The composition of the invention, in its most simple form, may be generally described as a mixture of an acid package of inorganic bisulfate and an inorganic salt, and surfactant, the inorganic salt having an acidic or neutral pH when by itself. That is, the inorganic salt has a pH that is in the range of 1-7, preferably about 1-6, although in some embodiments inorganic salts having a pH of 1-8 may be suitable. In many embodiments, the acid package is an inorganic bisulfate salt and an inorganic bisulfate salt.

Acid Package

The bisulfate/salt combination provides system that, in equilibrium, readily maintains an acidic pH of about 1-7. By maintaining that range of pH, the bisulfate retains its identity as the hydrogen sulfate anion, $HSO_4^-$, and minimizes formation of sulfuric acid. In some embodiments, a pH range of about 3-5, or even 2-4, is desired. A generic equation for the acid package equilibrium is provided below:

$$M_mH_nA=M_{m+n}A$$

An example equilibrium system, using sodium bisulfate and sodium sulfate, is provided below.

$$2NaHSO_4=Na_2SO_4+H_2SO_4$$

Bisulfate, in the presence of water, has a tendency to create sulfate and sulfuric acid; sulfuric acid is generally undesirable when cleaning and/or polishing surfaces. By providing the sulfate or other inorganic salt, the equilibrium is pushed back toward the bisulfate form, thus reducing or inhibiting the formation of sulfuric acid. The inorganic salt should be present in the acid package at a level sufficient to inhibit or reduce the formation of sulfuric acid, as compared to having no inorganic salt present.

It is desired to reduce, inhibit, and otherwise minimize the presence of sulfuric acid in the cleaning composition, as sulfuric acid has the potential to, and usually does, damage the surface of metal, particularly aluminum. The damage observed is typically pitting of the metal, which not only is visually undesirable, but may weaken the metal structure.

The bisulfate and inorganic salts used to form the cleaning composition may have any inorganic cation or mixtures of cations, however, those from groups IA and IIA, as well as an ammonium cation, are preferred. Potassium and sodium cations are especially preferred.

In the composition, the bisulfate and inorganic salt will go to their equilibrium state, based on the acidity of the composition. A bisulfate/sulfate combination provides a system that, in equilibrium, readily maintains an acidic pH of 2-3.

The amount of starting or initial bisulfate and salt is broad. The final ratio of bisulfate to salt is dependent on the pH of the overall composition, which can be adjusted by various additives. The inorganic salt is present at a level to inhibit formation of sulfuric acid, when the composition is in contact with water. Generally, the weight ratio of bisulfate to inorganic salt, as raw materials or initial ingredients, is about 1/100 to 100/1. Preferably, the weight ratio of bisulfate to inorganic salt is about 1/25 to 25/1, more preferably from 1/10 to 10/1. Other ranges of bisulfate to inorganic salt are also suitable, such as weight ratios of 1/5 to 5/1, 1/3 to 3/1, 1/2 to 2/1, and about 1/1. Suitable and preferred ranges of bisulfate to sulfate include 1/5 to 5/1, 1/3 to 3/1, 1/2 to 2/1, and about 1/1. The bisulfate and inorganic salt, both individually and as a combination, are present at a level sufficient to provide a brightening affect when applied to a metal surface. A "brightening affect" is one that, with the naked human eye, is noticed to be brighter than prior to the treatment.

Sulfate salt is a preferred inorganic salt to use with the bisulfate, although other salts, including chloride, phosphate, carbonate can be used.

Various other acidic materials may be added to the bisulfate/salt acid package, however, these other materials preferably provide no noticeable cleaning affect due to that material. That is, the cleaning effect is provided by the bisulfate/salt acid package, for example, the bisulfate/sulfate package. A noticeable cleaning affect is when materials such as soil, dirt, oil and grease, road grime, road salt, or brake dust are removed from a surface at a level where a naked human eye can notice a different is shine and/or reflectance of the surface. In general, at least about 20% of the material is removed from the surface in order to have a noticeable cleaning affect. In many situations, at least about 50% of the material is removed from the surface in order to have a noticeable cleaning affect.

To provide noticeable cleaning affect, most materials need to be present at a level of at least about 10 wt-% of the acid package, although, depending on the materials, levels of about 5% or 3% or 2% may provide a noticeable cleaning affect. Thus, any non-bisulfate/salt materials, if present, are present at a level that provides no noticeable cleaning affect.

The presence of sulfites in either the acid package or composition should be avoided, and in various embodiments, sulfites can be excluded. Sulfites can have a tendency to react with the bisulfate, producing undesirable materials. If any sulfite is present, it should be at a level of no more than about 10% of the acid package, preferably no more than about 1% of the acid package, for example, no more than about 0.1%. The avoidance to sulfites inhibits the formation of sulfuric acid. Other materials to be preferably avoided and which can be excluded include hydrofluoric acid, bifluorides, and oxalic acid.

Surfactant

Surfactant, typically more than one surfactant, is present in the composition. Exemplary types of surfactants that can be included include anionic surfactants, cationic surfactants, nonionic surfactants, and zwitterionic or amphoteric surfactants.

The anionic surfactant component can include a detersive amount of an anionic surfactant or a mixture of anionic surfactants. Anionic surfactants are often desirable in cleaning compositions because of their wetting and detersive properties, which facilitate the removal of inorganic soils such as road dust. The anionic surfactants that can be used include any anionic surfactant available in the cleaning industry. Exemplary groups of anionic surfactants include carboxylates, isethionates, sulfonates, sulfates, their polymers or copolymers and mixtures thereof. Exemplary surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates. Sulfonates are a preferred type of anionic surfactant with primary and secondary alkane sulfonates, olefin sulfonates, and aryl sulfonates preferred.

Exemplary alkyl aryl sulfonates that can be used in the cleaning composition can have an alkyl group that contains 6 to 24 carbon atoms and the aryl group can be at least one of benzene, toluene, and xylene. An exemplary alkyl aryl sulfonate includes linear alkyl benzene sulfonate. An exemplary linear alkyl benzene sulfonate includes linear dodecyl benzyl sulfonate that can be provided as an acid that is neutralized to form the sulfonate. Additional exemplary alkyl aryl sulfonates include xylene sulfonate and cumene sulfonate.

Exemplary alkane sulfonates that can be used in the cleaning composition can have an alkane group having 6 to 24 carbon atoms. Exemplary alkane sulfonates that can be used include secondary alkane sulfonates. An exemplary secondary alkane sulfonate includes sodium $C_{14}$-$C_{17}$ secondary alkyl sulfonate commercially available as Hostapur SAS from Clariant.

Exemplary alkyl methyl ester sulfonates that can be used in the cleaning composition include those having an alkyl group containing 6 to 24 carbon atoms.

Exemplary alpha olefin sulfonates that can be used in the cleaning composition include those having alpha olefin groups containing 6 to 24 carbon atoms.

Exemplary alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. An exemplary alkoxy group is ethoxy. An exemplary alkyl ether sulfate is sodium lauryl ether ethoxylate sulfate and is available under the name Steol CS-460.

Exemplary alkyl sulfates that can be used in the cleaning composition include those having an alkyl group containing 6 to 24 carbon atoms. Exemplary alkyl sulfates include sodium lauryl sulfate and sodium lauryl/myristyl sulfate.

Suitable cationic surfactants may include quaternary ammonium compounds, amine acid salts, quaternary phosphonium compounds, quaternary sulfonium compounds, their polymers or copolymers, and mixtures thereof. Quaternary ammonium compounds and amine acid salts are preferred cationic surfactants, and are particularly suitable as a penetrant for road grime. Alkoxylated quaternary ammonium compounds are especially preferred.

Exemplary cationic surfactants that can be used include quaternary ammonium compounds and amine salts including those having the following formula:

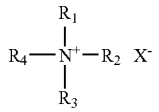

wherein $R_1$, $R_2$, $R_3$, and $R_4$ can, independently of each other, be hydrogen, $C_1$-$C_{24}$ branched, linear, alkyl, aryl, or aralkyl groups, and X can be an anion such as a halide, methosulfate, ethosulfate, carbonate, phosphate, sulfate, etc. A particularly preferred quaternary ammonium compound is commercially available as "Variquat CC-42NS" from Goldschmidt, which was found to be particularly suitable for acidic conditions.

Suitable nonionic surfactants may include aliphatic, aryl, or aryalkyl alkoxylates; EO-PO copolymers; alkoxylated amines or carboxylates; amides; polyglycosides and their derivatives, their polymers or copolymers, and mixtures thereof. Alcohol ethoxylates, EO-PO copolymers, and EO-PO derivatives of ethylenediamine are preferred nonionic surfactants.

Exemplary nonionic surfactants include alcohol alkoxylates, ethylene oxide-propylene oxide copolymers, alkyl polyglycosides, alkanolamides, and mixtures thereof. Exemplary alcohol alkoxylates include alcohol ethoxylates, alcohol propoxylates, alkyl phenol ethoxylate-propoxylates, and mixtures thereof.

Exemplary nonionic block copolymer surfactants include polyoxyethylene-polyoxypropylene (EO-PO) block copolymers. Exemplary polyoxyethylene-polyoxypropylene block copolymers that can be used have the formulae:

$$(EO)_x(PO)_y(EO)_x$$

$$(PO)_y(EO)_x(PO)_y$$

$$(PO)_y(EO)_x(PO)_y(EO)_x(PO)_y$$

wherein EO represents an ethylene oxide group, PO represents a propylene oxide group, and x and y reflect the average molecular proportion of each alkylene oxide monomer in the overall block copolymer composition. Preferably, x is from about 10 to about 130, y is about 15 to about 70, and x plus y is about 25 to about 200. It should be understood that each x and y in a molecule can be different. The total polyoxyethylene component of the block copolymer is preferably at least about 20 mol-% of the block copolymer and more preferably at least about 30 mol-% of the block copolymer. The material preferably has a molecular weight greater than about 1,500 and more preferably greater than about 2,000. Although the exemplary polyoxyethylene-polyoxypropylene block copolymer structures provided above have 3 blocks and 5 blocks, it should be appreciated that the nonionic block copolymer surfactants can include more or less than 3 and 5 blocks. In addition, the nonionic block copolymer surfactants can include additional repeating units such as butylene oxide repeating units. Furthermore, the nonionic block copolymer surfactants that can be used can be characterized heteric polyoxyethylene-polyoxypropylene block copolymers. Exemplary materials are available from BASF under the name Pluronic, and an exemplary EO-PO co-polymer that can be used is available under the name Pluronic N3. EO-PO co-polymers provide good sheeting action on the surface being cleaned.

Alcohol alkoxylate surfactants that can be used according to the invention can have the formula:

$$R(AO)_x\text{-}X$$

wherein R is an alkyl group containing 6 to 24 carbon atoms, AO is an alkylene oxide group containing 2 to 12 carbon atoms, x is 1 to 20, and X is hydrogen or an alkyl or aryl group containing 1-12 carbon atoms. The alkylene oxide group is preferably ethylene oxide, propylene oxide, butylene oxide, or mixture thereof. In addition, the alkylene oxide group can include a decylene oxide group as a cap.

Alkyl polyglycoside surfactants can have the formula:

$$(G)_x\text{-}O\text{—}R$$

wherein G is a moiety derived from reducing saccharide containing 5 or 6 carbon atoms, e.g., pentose or hexose, R is a fatty aliphatic group containing 6 to 24 carbon atoms, and x is the degree of polymerization (DP) of the polyglycoside representing the number of monosaccharide repeating units in the polyglycoside. The value of x can be between about 0.5 and about 10. R can contain 10-16 carbon atoms and x can be 0.5 to 3.

Alkanolamides that can be used as nonionic surfactants include alkanolamides having the following formula:

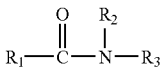

wherein $R_1$ is $C_6$-$C_{20}$ alkyl group, $R_2$ is hydrogen or a $C_1$-$C_3$, and $R_3$ is hydrogen or a $C_1$-$C_3$ alkyl group. An exemplary alkanolamide is available as cocodiethanolamide.

The zwitterionic surfactants that can be used include β-N-alkylaminopropionates, N-alkyl-β-iminodipropionates, imidazoline carboxylates, N-alkylbetaines, sulfobetaines, sultaines, amine oxides and polybetaine polysiloxanes. Exemplary polybetaine polysiloxanes have the formula:

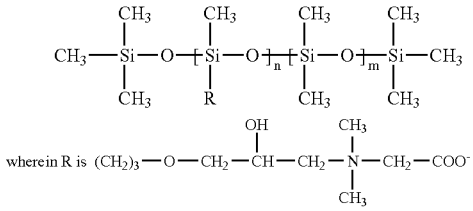

n is 1 to 100 and m is 0 to 100, preferably 1 to 100. Preferred polybetaine polysiloxanes are available under the name ABIL® from Goldschmidt Chemical Corp. Preferred amine oxides that can be used include alkyl dimethyl amine oxides containing alkyl groups containing 6 to 24 carbon atoms. An exemplary amine oxide is lauryl dimethylamine oxide.

Exemplary amphoteric surfactants include betaines, amine oxides, sultaines, amphoacetates, imidazoline derivatives, and mixtures thereof.

The total amount of surfactant in the composition, for a concentrate composition, is generally about 0.01 to 50 wt. %, typically about 0.1 to 35 wt. %. The total amount of surfactant in a ready-to-use composition is generally about 0.001 to 35 wt. %, typically about 0.01 to 20 wt. %. Generally, more than one surfactant is present in the composition.

The ratio of surfactant to combined bisulfate (initially added) and inorganic salt would be from about 1/100 to 100/1; a preferred ratio from about 1/25 to 25/1; more preferred from about 1/10 to 10/1; an especially preferred ratio is from about 2/1 to 1/2.

Foamed Cleaning Composition

The cleaning composition according to the invention can be foamed and applied to a surface. In general, it is expected that the cleaning composition will provide cleaning in environments where application of a foam to a surface is advantageous. An exemplary environment where application of a foam to a surface is advantageous is where the foam provides for increasing contact time between the cleaning composition and the surface to be cleaned. By providing the cleaning composition in the form of a foam, the tendency of the cleaning composition to run or level when applied to a surface can be reduced. When cleaning a non-horizontal surface (such as a vertical surface), providing the cleaning composition in the form of a foam can enhance cling that allows the foam cleaning composition to remain in place and resist running off or down the non-horizontal surface as a result of gravity. Exemplary non-horizontal surfaces that are often cleaned include wheel hubs and rims, walls, doors, and other vertical surfaces. In the case of horizontal surfaces, the foam cleaning composition can resist leveling. This is advantageous in a situation, such as, cleaning a floor where it is desirable to have the foam cleaning composition remain in a specific location on the floor without seeping across the floor and/or under a door.

When the cleaning composition is provided as a foam, the composition has a cellular structure that can be characterized as having several layers of air cells that provide the composition with a foamy appearance. It should be understood that the characterization of a foam refers to the existence of more than simply a few air bubbles. In general, a foam can be characterized as having at least 50 wt. % foam using a 15 second vertical separation test. The test is carried out by spraying the cleaning composition as a foam onto a vertical surface such as aluminum, waiting 15 seconds after application of the foam to the vertical surface, and then taking up the liquid portion and the foam portion in separate preweighed paper towels. The weight of the absorbed liquid can be calculated and the weight of the absorbed foam can be calculated. By providing a separation time of at least 15 seconds, it is believed that a reasonable amount of separation of liquid and foam can be achieved. The towel picking up the liquid portion should not pick up any of the foam portion, and the towel picking up the foam portion should not pick up the liquid portion that has fallen below the foam portion. It is understood that the foam portion may still include a small amount of associated liquid. However, this associated liquid is considered a part of the foam as long as it remains with the foam at the 15 second cut off time. The weight percent foam can be calculated by dividing the weight of the foam component by the total weight and multiplying by 100. The 15 second vertical separation test can be referred to as a "gravimetric foam test after 15 seconds." The cleaning composition preferably provides at least 70 wt. % foam according to the gravimetric foam test after 15 seconds, more preferably at least about 75 wt. % foam, and even more preferably at least about 90 wt. % foam. In general, it is desirable to have the foam hang up and not fall down a vertical surface to provide desired contact time and to allow a person sufficient time to work the foam at its intended location. The period of 15 seconds is selected for the test because it is expected that a foam will likely "hang" for at least about 15 seconds and any free liquid, if present at all, will have an opportunity to separate from the foam and fall down the vertical surface. In addition, the foam persists for at least about 15 seconds after application to a surface. This means that the foam will have a tendency to remain as a foam and will resist condensing to a liquid in order to provide the above-identified weight percent foam. More preferably, the foam persists for at least about 1 minute after application to the surface.

The cleaning composition can be formulated for various types of cleaning applications where delivery as a foam is advantageous. Exemplary applications where delivery as a foam is advantageous include hard surface cleaning compositions, detergents, wheel cleaners, tire dressings, and polishes. When used as a hard surface cleaner, the composition can be applied to stainless steel, aluminum, copper, vinyl, plastic, metal, glass, rubber (natural and synthetic), formica, wood, mild steel, melamine, brass, ceramic, stone, etc. When applied to aluminum, the composition also brightens the aluminum surface, by removing oxidation. When the composition is provided as a cleaner, it can be applied to appliances and other devices such as refrigerators, stoves, dishwashers, elevators, doors, faucets, countertops, sinks, etc.

The composition according to the invention can be foamed without the use of a propellant, and applied as a foam directly to a surface. A solvent can assist in the generation of a foam when the composition is processed through a mechanical foaming head. The solvents that assist in the generation of a foam can be referred to as "foam-boosting solvents." Mechanical foaming heads that can be used to provide foam generation include those heads that cause air and the cleaning composition to mix and create a foamed composition. That is, the mechanical foaming head causes air and the cleaning composition to mix in a mixing chamber and then pass through an opening to create a foam.

The cleaning composition according to the invention can be foamed without the use of a propellant normally associated with aerosol compositions. In general, aerosol compositions include a pressurized container for storing a composition and a propellant. The expansion of the propellant in the composition and propellant mixture as it passes through a nozzle causes the cleaning composition to become foamed. A mechanical foaming head, in contrast, relies upon air from the environment and causes the air to mix with the liquid composition to become foamed. While it is understood that operating the mechanical foaming head may result in a compression of the air within the mixing chamber, it is pointed out that the container that stores the cleaning composition is not considered pressurized even though the pressure inside the container may be slightly higher or lower than ambient pressure at times.

Propellants that are often used in aerosols include liquids that form gases when expanded to atmospheric pressure. Exemplary propellants commonly used in aerosols include fluorocarbons, chlorofluorocarbons, and alkanes such as butane, ethane, isobutane, and propane. Propellants in general and these propellants in particular can be excluded from the cleaning composition according to the invention or they can be limited to an amount, if any are present, that is insufficient to provide foaming of the composition as a result of pressure drop (such as through an aerosol nozzle) so that the composition contains at least 50 wt. % foam according to a 15 second vertical separation test. Air has a tendency not to compress to a liquid under conditions normally encountered in conventional aerosol devices. Air is not considered a propellant according to the present invention even though it may be slightly compressed using the mechanical foaming head according to the invention. The term "propellant" as used herein should be understood to not refer to air and can be characterized as non-air containing propellants. The foam according to the invention can be characterized as having been formed by air rather than by a propellant. Because propellants are typically provided in a liquid form in combination with a liquid to be foamed, and form bubbles in the liquid as the propellant vaporizes as pressure drops, it is expected that the foam that is foamed by a propellant will contain residual propellant. It is believed that the residual propellant can be measured by a gas chromatographic head space analysis. It is expected that foams produced using a propellant will exhibit a concentration of propellant in the foam of greater than 1 ppm. Accordingly, the foam according to the invention includes less than 1 ppm propellant as measured by a gas chromatographic head space analysis. Preferably, the foam according to the invention has no propellant. That is, the foam can be produced using air and need not be produced using a propellant.

Because the foam according to the invention can be prepared without a propellant, the container that holds the liquid cleaning composition can be constructed so that that it is capable of holding the cleaning composition under substantially atmospheric conditions both inside and outside the container. Because propellants are not used, the container need not be a container capable of withstanding the pressures normally associated with aerosol containers. Accordingly, the container can be provided from a plastic or polymer material rather than from a metallic material normally associated with aerosol containers.

Exemplary mechanical foaming heads that can be used include those available from Airspray International, Inc. of Pompano Beach, Fla., and from Zeller Plastik, a division of Crown Cork and Seal Co. Exemplary mechanical foaming heads that can be used according to the invention are described in, for example, U.S. Pat. No. D-452,822; U.S. Pat. No. D-452,653; U.S. Pat. No. D-456,260; and U.S. Pat. No. 6,053,364. Mechanical foaming heads that can be used according to the invention includes those heads that are actuated or intended to be actuated by application of finger pressure to a trigger that causes the cleaning composition and air to mix and create a foam. That is, a person's finger pressure can cause the trigger to depress thereby drawing the cleaning composition and air into the head and causing the cleaning composition and air to mix and create a foam.

Now referring to FIG. 1, a first foam dispenser is shown at reference number 10. Foam dispenser 10 includes a container 12 holding a liquid cleaning composition 14, and a mechanical foaming head 16 attached to container 12. Volume of container 12 not occupied by liquid composition 14 is referred to as air headspace 28. Mechanical foaming head 16 includes a liquid inlet line 18 that draws liquid cleaning composition 14 into mechanical foaming head 16. In addition, an air inlet 20 draws air into mechanical foaming head 16. Air inlet 20 for foam dispenser 10 is provided within container 12. That is, air 22 located within container 12 is drawn in through air inlet 20. It is understood that mechanical foaming head 16 provides for venting of air 22. The air 22 from air inlet 20 and liquid cleaning composition 14 from liquid inlet line 18 combine in a mixing chamber 24 and then are forced through an outlet 26 to outside of the foam dispenser 10. The resulting foam can be applied to various surfaces. Mixing chamber 24 and outlet 26 can be considered a part of mechanical foaming head 16.

Foam dispenser 10 can be operated by depressing a trigger 30 using, for example, finger pressure or finger actuation. The operator can press trigger 30 causing liquid and air to flow into mixing chamber 24 and out outlet 26. When trigger 30 is released, air is allowed to flow into headspace 28 from outside foam dispenser 10. It should be understood that although air 22 within headspace 28 can be used for mixing with liquid cleaning composition 14 inside mixing chamber 24, it should be understood that the container can be designed so that air is drawn from outside of container 12 rather than from headspace 28. In addition, various techniques can be used to vent headspace 28.

Figure 2:
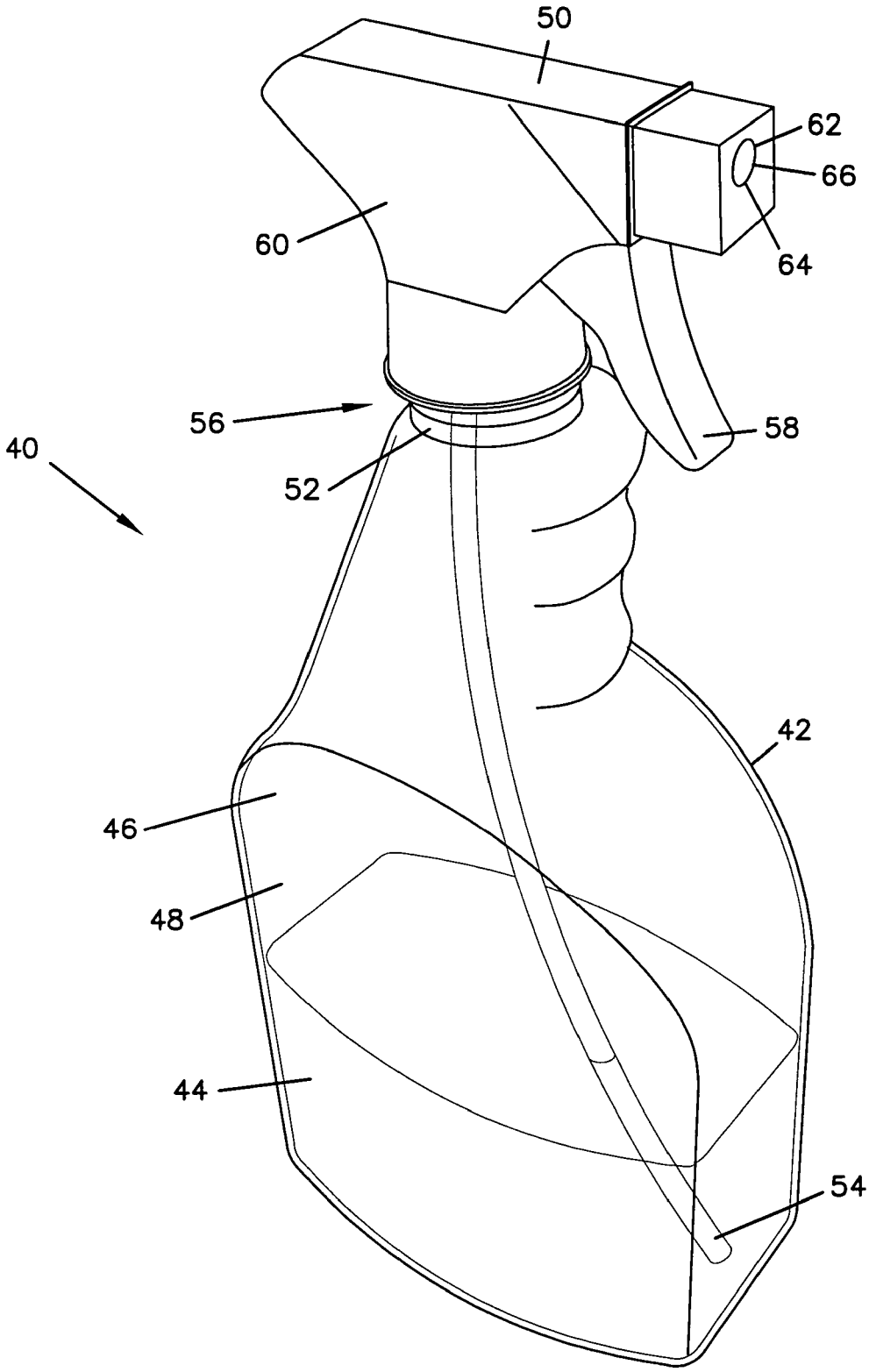
FIG. 2 is a perspective view of a foam dispenser suitable for use with the composition of the invention.

Now referring to FIG. 2, a second foam dispenser is shown at reference number 40. Foam dispenser 40 includes a container 42 holding a liquid 44. In addition air 46 is provided in a headspace 48. Foam dispenser 40 additionally includes a mechanical foaming head 50 having a trigger 58 attached to container 42 at a container neck 52. A liquid inlet line 54 draws liquid 44 into mechanical foaming head 50. In addition, an air inlet 56 draws air into mechanical foaming head 50. When trigger 58 of foaming head 50 is depressed, liquid and air flow into mechanical foaming head 50 into a liquid and air mixing chamber 60, and through an outlet 62 to outside of foam dispenser 40. Outlet 62 can include a foam generating opening 64 that assists in the generation of a foam when the combination of the air and the liquid pass there through. Foam generating opening 64 can include a foam generating structure such as a screen 66. In general, foam generating structure 64 can be any structure that creates turbulence and/or enhancing mixing of air and liquid to generate foaming. For example, the foam generating structure can include obstructions or projections into the path through which the air and the liquid pass. Exemplary foam generating structures include narrow orifices, tubes, etc. It is expected that foam dispenser 40 utilizes less intense mixing in mixing chamber 60 compared with the level of mixing obtained in mixing chamber 24 of the foam dispenser 10 (FIG. 1). As a result, foam generating structure 64 can be provided to enhance contact between the liquid and the air to generate foaming.

Foam dispersers 10, 40 are suitable for use with the composition of the present invention.

Figure 3:
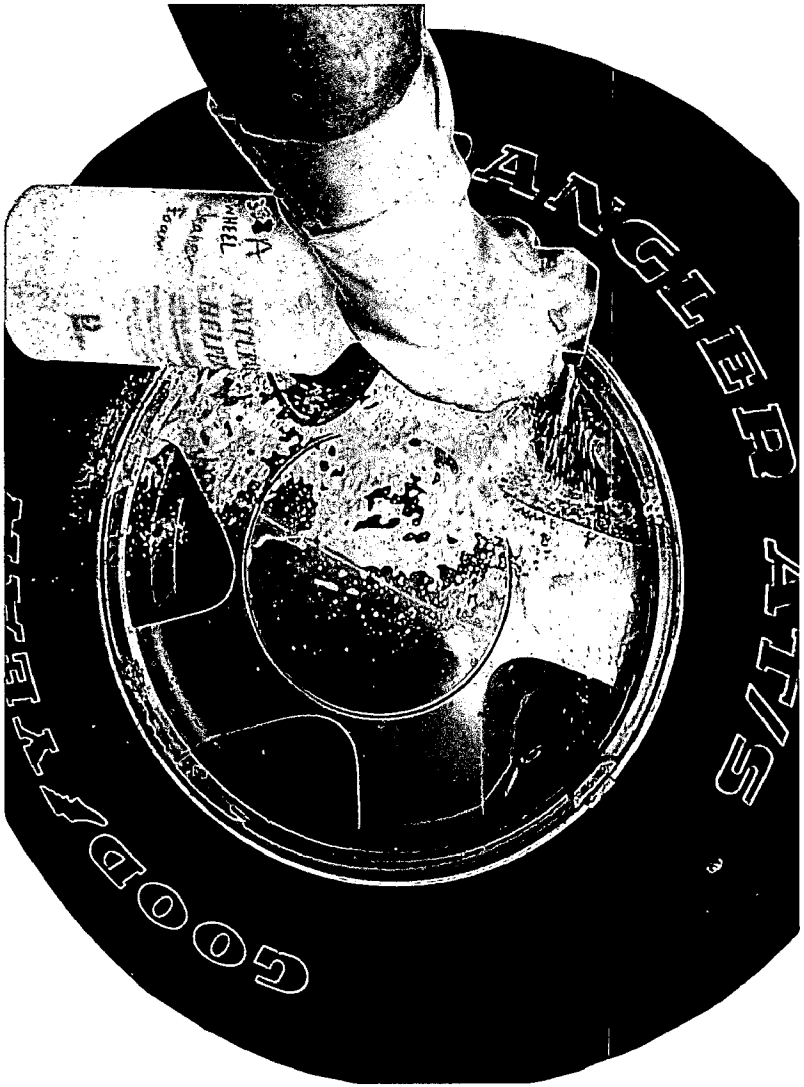
FIG. 3 is a photograph of the foam composition of the invention being applied via foam dispenser to an automobile wheel.

FIG. 3 is a photograph of the foam composition of the invention being applied via foam dispenser 40 to an automobile wheel. It is seen that the foam composition clings to the vertical wheel surface with minimal dripping.

Foam-Boosting Solvents

To facilitate the foaming of the composition, a foam-boosting solvent can be added. Not all solvents will necessarily function as foam-boosting solvents to cause a composition to foam when processed through a mechanical foaming head. Certain types of solvents that have been found to function as foam-boosting solvents can be characterized in several ways. For example, foam-boosting solvents that have assisted in the generation of a foam when a composition is processed through a mechanical foaming head can be characterized as having an HLB (hydrophilic-lipophilic balance) value of at least about 6.9 and an OHLB (organic hydrophilic-lipophilic balance) value of between about 12 and about 20. HLB is a measure of water miscibility with values of 7.3 or greater corresponding to complete water solubility. OHLB values refer to the partitioning ability between water and organic phase with higher OHLB values corresponding to a greater tendency to partition into the organic phase. HLB values and OHLB values for solvents are readily available for most solvents. Exemplary foam-boosting solvents that can be used can also be characterized as having a vapor pressure at room temperature of less than about 5 mmHg. The vapor pressure at room temperature can be less than about 1 mmHg, and can be less than about 0.1 mmHg. In addition, it may be desirable to provide the foam-boosting solvent as one characterized as GRAS (generally recognized as safe) by the FDA for direct or indirect food additives.

Exemplary foam-boosting solvents include glycols, glycol ethers, derivatives of glycol ethers, and mixtures thereof. Exemplary glycols include those having at least four carbon atoms such as hexylene glycol. Exemplary glycol ethers include alkylene glycol ethers and aromatic glycol ethers. Exemplary glycol ethers include those having the formula:

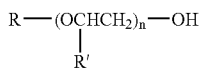

wherein R is a $C_1$-$C_6$ aliphatic or aromatic group, R' is H, $CH_3$, or $C_2H_5$, and n has a value of at least 1. The value of n can be about 1 to about 4, or about 1 to about 3. An exemplary glycol ether includes dipropylene glycol methyl ether wherein R is $CH_3$, R' is $CH_3$, and n has a value of 2. Another exemplary glycol ether is diethylene glycol butyl ether (sometimes referred to as butyl carbitol) wherein R is $C_4H_9$, R' is H, and n has a value of 2. An exemplary aromatic glycol ether is ethylene glycol phenyl ether wherein R is a phenyl group, R' is H, and n is a value of 1. Other exemplary glycol ethers include $C_1$-$C_6$ alkylene glycol ethers such as propylene glycol butyl ether, dipropylene glycol propyl ether, ethylene glycol butyl ether, diethylene glycol propyl ether, and triethylene glycol methyl ether. Exemplary glycol ethers are commercially available under the name Dowanol® from the Dow Chemical Company. For example, n-propoxypropanol is available under the name Dowanol PnP. Exemplary derivatives of glycol ethers include those glycol ethers modified to include an additional group or functionality such as an ester group. Exemplary derivatives of glycol ethers include those having the following formula:

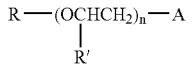

wherein R is a $C_1$-$C_6$ aliphatic or aromatic group, R' is H, $CH_3$, or $C_2H_5$, n has a value of at least 1, and A is an ester, amide, or ether group. The value of n can be about 1 to about 4, or about 1 to about 3. An exemplary derivative of a glycol ether includes propylene glycol methyl ether acetate. It should be understood that certain glycol ethers and derivatives such as ethylene glycol phenyl ether can be used with additional solvents for coupling.

The composition can include an amount of the foam-boosting solvent to provide a desired foam when processed through a mechanical foaming head. It has been found that the amount of foam-boosting solvent that can be provided to assist in the generation of a foam can be provided in an amount that does not significantly decrease the viscosity of the composition prior to foaming. That is, the amount of the foam-boosting solvent can be provided so that the composition that includes the foam-boosting solvent has a viscosity that is within about 50 centipoise of an otherwise identical composition except not including the foam-boosting solvent when the viscosity is measured on a Brookfield viscometer, model DV-E, at 22° C. a spindle speed of 100 rpm and a number 4 spindle, or at a spindle and speed that provides for measurement of viscosity. It is expected that the foam-boosting solvent will be present in the composition, if at all, in an amount of at least about 0.1 wt. %, and can be included in an amount up to about 5 wt. %. An exemplary range of foam-boosting solvent in the composition is between about 0.1 wt. % and about 3 wt. %. Another exemplary range of the foam-boosting solvent is between about 0.5 wt. % and about 2 wt. %.

It is believed that the foam-boosting solvent can be provided in a composition containing a relatively low concentration of surfactant to help assist in the generation of a foam when processed through a mechanical foaming head. The amount of the foam-boosting solvent can be provided based upon the amount of total surfactant in the composition. For example, when the total amount of surfactant is relatively low, it is desirable to provide enough foam-boosting solvent so that the composition generates a foam when processed through a mechanical foaming head.

It is expected that at total surfactant concentrations of about 0.05 wt. % to about 10 wt. %, the foam-boosting solvent can be provided at a concentration of about 0.1 wt. % to about 5 wt. %, a concentration of between about 0.5 wt. % and about 3 wt. %, and a concentration of between about 1 wt. % and about 2 wt. %.

Other Optional Ingredients

As stated above, in its basic form, the composition of the present invention is a mixture of inorganic bisulfate salt, inorganic salt, and surfactant. If the composition is a foam composition, a foam-boosting solvent is present. Other ingredients can be added to this basic composition. Examples of optional ingredients for the composition include amphoteric surfactants (amine oxides, betaines, sultaines, amphoacetates, amphopropionates, etc.), aesthetic aids (fragrance, dyes, optical brighteners, etc.), viscosity modifiers (polymers, clay, etc.), solvents (water, glycol ethers, glycols, pyrrol and it's derivatives, alkyl carbonates, etc.), builders/chelants/sequestrants (phosphates, diamine derivatives, nitriloacetates, organophosphonates, polycarboxylates, hydroxycarboxylates, derivatives of aspartic acid, etc.), and processing aids (inorganic salts, excluding fluorides and bifluorides; polyethylene and/or polypropylene glycol; urea; inorganics carbonates and bicarbonates; inorganic halides; etc.).

Water

The composition concentrate is typically diluted with water to provide the ready-to-use composition and/or the use composition. In general, it is expected that the concentrate will be diluted with water at a weight ratio of at least about 1:1. In addition, it is expected that the dilution of the concentrate with water will be less than about 1:600. It is understood that a weight ratio of about 1:600 is slightly less than a dilution of about ¼ ounce concentrate to about 1 gallon of water. It is expected that the ready-to-use composition or the use composition will contain at least about 80 wt. % water. In addition, it is expected that the ready-to-use composition and/or the use composition will include at least about 90 wt. % water, preferably at least about 95 wt. % water, and more preferably at least about 96 wt. % water. In some read-to-use compositions, the level of water will be at least about 99 wt. %.

pH Modifier

The acid system, of the bisulfate and the inorganic salt, is naturally acidic with a pH of 1-7. An acid system of the bisulfate and the sulfate is naturally acidic with a pH of 2-3. In many embodiments, it is desired to modify that pH. The level of the pH will affect the ratio of bisulfate and salt (e.g., sulfate) in equilibrium. Exemplary pH modifiers include alkalinity sources and acidity sources. Exemplary alkalinity sources include inorganic bases (hydroxides, carbonates, bicarbonates, percarbonates, silicates, etc.) and organic bases (alkylamines, alkanolamines, etc.). Exemplary acidity sources include inorganic acids (bisulfates, phosphoric acid, hydrochloric acid, etc.) and organic acids (polycarboxyacids, hydroxycarboxylic acids, etc.).

It can be desirable to provide the use solution with a relatively neutral pH, alkaline pH, or acidic pH. In many situations, it is believed that the presence of hard water as water of dilution will cause the use solution to exhibit a neutral or alkaline pH. In order to ensure a relatively neutral pH, alkaline pH, or acidic pH a pH modifier can be incorporated into the concentrate. In general, the amount of pH modifier should be sufficient to provide the use solution with a pH in the desired range. Exemplary ranges include 1-6,7-8, and 9-14.

The pH modifier can include an alkalinity source. The alkalinity source can be organic and/or inorganic. Exemplary alkaline buffering agents include alkanolamines. An exemplary alkaline alkanolamine organic pH modifier is beta-aminoalkanol and 2-amino-2-methyl-1-propanol (AMP).

Exemplary alkanolamines are beta-aminoalkanol compounds. They serve primarily as solvents when the pH is about 8.5, and especially above about 9.0. They also can provide alkaline buffering capacity during use. Exemplary beta-aminoalkanols are 2-amino-1-butanol; 2-amino-2-methyl-1-propanol; and mixtures thereof. Beta-aminoalkanol is 2-amino-2-methyl-1-propanol can be desirable because of its low molecular weight. The beta-aminoalkanols can have boiling points below about 175° C.

Other suitable alkalinity agents that can also be used include alkali metal hydroxides, i.e., sodium, potassium, etc., and carbonates or sodium bicarbonates. Water-soluble alkali metal carbonate and/or bicarbonate salts, such as sodium bicarbonate, potassium bicarbonate, potassium carbonate, cesium carbonate, sodium carbonate, and mixtures thereof, can be added to the composition of the present invention in order to improve the filming/streaking when the product is wiped dry on the surface, as is typically done in glass cleaning. Preferred salts are sodium carbonate, potassium carbonate, sodium bicarbonate, potassium bicarbonate, their respective hydrates, and mixtures thereof.

Exemplary inorganic acids include phosphoric acid, hydrochloric acid, nitric acid, sulfamic acid, mixtures thereof, or the like. Exemplary organic acids include lactic acid, citric acid, propionic acid, acetic acid, hydroxyacetic acid, formic acid, glutaric acid, maleic acid, hydroxy propionic acid, succinic acid, glutaric acid, adipic acid, fumaric acid, mixtures thereof, or the like. The organic acid can be a mixture of adipic, maleic, and succinic acids sold under the trade name Sokalan.

Solvents

Solvents other than foam-boosting solvents can be included in the composition to provide the composition with desired properties. For example, certain solvents can be included in an amount to provide the desired cleaning and evaporative properties. In general, the amount of solvent should be limited so that the use solution is in compliance with volatile organic compound (VOC) regulations for a particular class of cleaner. In addition, it should be understood that the organic solvent is an optional component and need not be incorporated into the concentrate or the use solution according to the invention. When the organic solvent is included in the concentrate, it can be provided in an amount of between about 0.1 wt. % and about 50 wt. %, between about 5 wt. % and about 30 wt. %, and between about 10 wt. % and about 20 wt. %.

Builder/Sequestrant

The cleaning composition according to the invention can include complexing or chelating agents that aid in reducing the harmful effects of hardness components in service water. Typically, calcium, magnesium, iron, manganese, or other polyvalent metal cations, present in service water, can interfere with the action of cleaning compositions. A chelating agent can be provided for complexing with the metal cation and preventing the complexed metal cation from interfering with the action of an active component of the rinse agent. Both organic and inorganic chelating agents are common. Inorganic chelating agents include such compounds as sodium pyrophosphate, and sodium tripolyphosphate. Organic chelating agents include both polymeric and small molecule chelating agents. Polymeric chelating agents commonly comprise ionomer compositions such as polyacrylic acids compounds. Small molecule organic chelating agents include aminocarboxylates, polycarboxylates, and hydroxycarboxylates. Exemplary aminocarboxylates include ethylenediaminetetracetic acid (EDTA), and hydroxyethylenediaminetetracetic acid, nitrilotriacetic acid, ethylenediaminetetrapropionates, triethylenetetraminehexacetates, and salts thereof including alkali metal ammonium and substituted ammonium salts. Exemplary polycarboxylates include citric acid and citrate salt. Exemplary hydroxycarboxylates include hydroxyacetic acid, salicylic acid, and salts thereof.

Phosphonates are also suitable for use as chelating agents in the composition of the invention and include ethylenediamine tetra(methylenephosphonate), nitrilotrismethylenephosphonate, diethylenetriaminepenta(methylene phosphonate), hydroxyethylidene diphosphonate, and 2-phosphonobutane-1,2,4-tricarboxylic acid. Preferred chelating agents include the phosphonates amino-carboxylates. These phosphonates commonly contain alkyl or alkylene groups with less than 8 carbon atoms.

It should be understood that the concentrate can be provided without a component conventionally characterized as a builder, a chelating agent, or a sequestrant. Nevertheless, it is believed that these components can advantageously be incorporated into the cleaning composition. It is expected that their presence would not be provided in an amount sufficient to handle the hardness in the water resulting from the water of dilution mixing with the concentrate to form the use solution when the water of dilution is considered to be fairly hard water and the ratio of water of dilution to the concentrate is fairly high.

Exemplary builders/sequestering agents include ethylenediamine derivatives, ethylenetriamine derivatives, NTA, phosphates, organophosphonates, zeolites, hydroxyacids, their salts, and mixtures thereof.

Anti-Redeposition Agent

Exemplary anti-redeposition agents that can be used include carboxycellulose derivatives, acrylate polymers and copolymers, and mixtures thereof.

The composition of the present invention can be provided in various forms, such as a liquid concentrate, liquid ready-to-use, or solid. Provided below are various compositional ranges for compositions that can be characterized as surface cleaning compositions. It should be understood that particular compositions can be provided within any of the ranges identified, and the compositions may include components other than those disclosed in the tables.

A preferred non-liquid composition, for forming into a mixture, dispersion or solution prior to use, can be described as containing various levels of ingredients, as provided below:

| | Wt-% | Wt-% | Wt-% |
|---|---|---|---|
| bisulfate (part of acid system) | 1-99 | 20-70 | 30-60 |
| metal inorganic salt (part of acid system), such as sulfate | 1-99 | 20-70 | 30-60 |
| EO-PO copolymer (nonionic surfactant) | 0.01-50 | 0.1-10 | 0.2-5 |
| alcohol ethoxylate (nonionic surfactant) | 0.01-50 | 0.1-10 | 0.2-5 |
| quaternary ammonium compound (cationic surfactant) | 0.01-20 | 0.05-10 | 0.07-5 |
| alkyl sulfonate (anionic surfactant) | 1-40 | 2-20 | 3-10 |

-continued

| | Wt-% | Wt-% | Wt-% |
|---|---|---|---|
| aryl sulfonate (anionic surfactant) | 0-20 | 0.1-10 | 0.3-8 |
| potassium hydrogen phosphate (carrier or builder) | 0-50 | 0-35 | 0-25 |

A preferred liquid concentrated composition, for further dilution prior to use, can be described as containing:

| | Wt-% | Wt-% | Wt-% |
|---|---|---|---|
| bisulfate (part of acid system) | 1-99 | 20-70 | 30-60 |
| metal inorganic salt (part of acid system), such as sulfate | 1-99 | 20-70 | 30-60 |
| EO-PO copolymer (nonionic surfactant) | 0.01-50 | 0.1-10 | 0.2-5 |
| alcohol ethoxylate (nonionic surfactant) | 0.01-50 | 0.1-10 | 0.2-5 |
| quaternary ammonium compound (cationic surfactant) | 0.01-20 | 0.05-10 | 0.07-5 |
| alkyl sulfonate (anionic surfactant) | 1-40 | 2-20 | 3-10 |
| aryl sulfonate (anionic surfactant) | 0-20 | 0.1-10 | 0.3-8 |
| glycol ether solvent (foam-boosting solvent) | 0-30 | 0.1-15 | 0.5-10 |
| Water | 1-99 | 30-80 | 40-70 |

A preferred ready-to-use liquid composition can be described as containing:

| | Wt-% | Wt-% | Wt-% |
|---|---|---|---|
| bisulfate (part of acid system) | 0.01-10 | 0.1-5 | 0.5-3 |
| metal inorganic salt (part of acid system), such as sulfate | 0.01-10 | 0.1-5 | 0.5-3 |
| EO-PO copolymer (nonionic surfactant) | 0.0001-5 | 0.001-1 | 0.002-0.5 |
| alcohol ethoxylate (nonionic surfactant) | 0.0001-5 | 0.001-1 | 0.002-0.5 |
| quaternary ammonium compound (cationic surfactant) | 0.0001-5 | 0.001-1 | 0.002-0.5 |
| alkyl sulfonate (anionic surfactant) | 0.01-10 | 0.05-5 | 0.1-0.5 |
| aryl sulfonate (anionic surfactant) | 0-10 | 0.05-5 | 0.1-0.5 |
| glycol ether solvent (foam-boosting solvent) | 0-5 | 0.1-3 | 0.5-2 |
| water | 10-99.99 | 40-99 | 60-98 |

In some use-compositions, the amount of acid package is no more than about 20 wt-%, no more than about 10 wt-% in other compositions, and no more than about 6 wt-% in other compositions. Also in some use-compositions, the amount of surfactant is no more than about 35 wt-%, no more than about 15 wt-% in other compositions, and no more than about 2.5 wt-% in other compositions.

Some exemplary components that can be included in the exemplary compositions shown in the above Tables are identified in the Examples below. It should be understood that the various exemplary components may be more useful in one type of composition than another.

EXAMPLES

The present invention can be better understood with reference to the following examples. These examples are intended to be representative of specific embodiments of the invention, and are not intended as limiting the scope of the invention.

Example 1

Solid Wheeler Cleaner Composition

Solid wheel cleaners were prepared by mixing the components listed below and then compressing the mixtures into solids. Five compositions (A, B, C, D and E) were prepared.

| Ingredient | Wt. % Comp. A | Wt. % Comp. B | Wt. % Comp. C | Wt. % Comp. D | Wt. % Comp. E |
|---|---|---|---|---|---|
| dodecylbenzene sulfonic acid | 1.52 | 2.96 | 2.75 | 2.80 | 3.35 |
| Tetronic 901 (BASF) | 0.46 | 0.90 | 0.83 | 0.85 | 1.01 |
| Variquat CC-42NS (Goldschmidt) | 0.05 | 0.09 | 0.08 | 0.08 | 0.10 |
| Pluronic N3 (BASF) | 0.37 | 0.72 | 0.67 | 0.68 | 0.81 |
| Hostapur SAS60 (Hoechst) | 1.93 | 3.76 | 3.50 | 3.56 | 0.00 |
| sodium octane sulfonate | 0.00 | 0.00 | 0.00 | 0.00 | 2.55 |
| nonyl phenol ethoxylate | 0.28 | 0.54 | 0.50 | 0.51 | 0.61 |
| sodium xylene sulfonate | 2.89 | 0.54 | 5.26 | 5.34 | 3.04 |
| $NaHSO_4$ | 46.18 | 45.25 | 38.92 | 41.50 | 44.33 |
| $Na_2SO_4$ | 46.33 | 45.25 | 19.57 | 41.39 | 44.20 |
| $KH_2PO_4$ | 0.00 | 0.00 | 20.41 | 0.00 | 0.00 |
| water | 0.00 | 0.00 | 0.00 | 3.30 | 0.00 |

The five compositions were evaluated for their pH, whether or not they were compressible into solid tablets, and whether or not the composition, when dissolved in water to form a solution, corroded aluminum 6061 or stainless steel 316. The results are below. All five compositions provided suitable results.

| | Comp. A | Comp. B | Comp. C | Comp. D | Comp. E |
|---|---|---|---|---|---|
| 1% pH | 2.13 | 2.18 | 2.25 | 2.19 | 2.20 |
| compressible? | yes | yes | yes | Yes | yes |
| corrodes aluminum 6061? | no | no | no | No | no |
| corrodes stainless steel 316? | no | no | no | No | no |

Example 2

Solid Aluminum Brightener

A composition was prepared from the ingredients below and compressed into a solid. A very dilute solution prepared from the minimal residue in the beaker that the solid was mixed in gave excellent brightening of an aluminum 6061 coupon.

| Ingredient | Wt. % |
|---|---|
| Sodium bisulfate | 35.60 |
| Sodium sulfate | 60.00 |
| Colonial IES quat | 1.44 |
| Varonic K1215 | 2.96 |

Example 3

Ready-to-Use Liquid Foam Wheel Cleaner Composition

A ready-to-use liquid wheel cleaner composition was prepared from the ingredients listed below and dispensed as a spray-on foam onto soiled automobile aluminum wheels, chromed wheels, and steel wheels. Brake dust and road soil were removed from all three wheels without any visible evidence of damage to any of the surfaces. The surface of the aluminum wheel was visibly brightened.

| Ingredient | Wt. % |
|---|---|
| Water | 97.42 |
| Sodium sulfate | 0.89 |
| Sodium bisulfate | 0.89 |
| Dodecylbenzene sulfonic acid | 0.08 |
| Tetronic 901 (BASF) | 0.02 |
| Variquat CC-42NS (Goldschmidt) | 0.002 |
| Pluronic N3 (BASF) | 0.01 |
| Hostapur SAS60 (Hoechst) | 0.07 |
| Laureth-Myristeth-7 EO | 0.01 |
| Sodium xylene sulfonate | 0.11 |
| Dipropylene glycol ether methyl ether | 0.50 |

Example 4

Comparison of Compositions

The composition of Example 3 was applied to aluminum 6061 coupons for 5 minutes at both ambient and at elevated temperature, 120° F. Similarly, three commercially available wheel cleaners were also used to treat aluminum 6061 coupons.

The two compositions containing bifluoride immediately attacked the aluminum with bubbling, pitting, and darkening of the metal. The composition having oxalic acid did not attack the aluminum, but neither did it brighten it. The composition according to the present invention, Example 3, brightened the dull aluminum coupon and did not adversely affect it, demonstrating an advantage over current products in performance and aluminum compatibility, even at elevated temperatures.

| Wheel Cleaner | Brightening Agent | Ambient | 120° F. |
|---|---|---|---|
| Example 3 | sodium bisulfate/sulfate | brightened | brightened |
| Meguiar's Instant Wheel Cleaner | ammonium bifluoride | pitting | severe pitting |
| Armor All Wheel Cleaner | ammonium bifluoride | pitting | severe pitting |
| Turtlewax Wheel Cleaner | oxalic acid | no change | no change |

Example 5

Removal of Dirt and Grime

Figure 4:
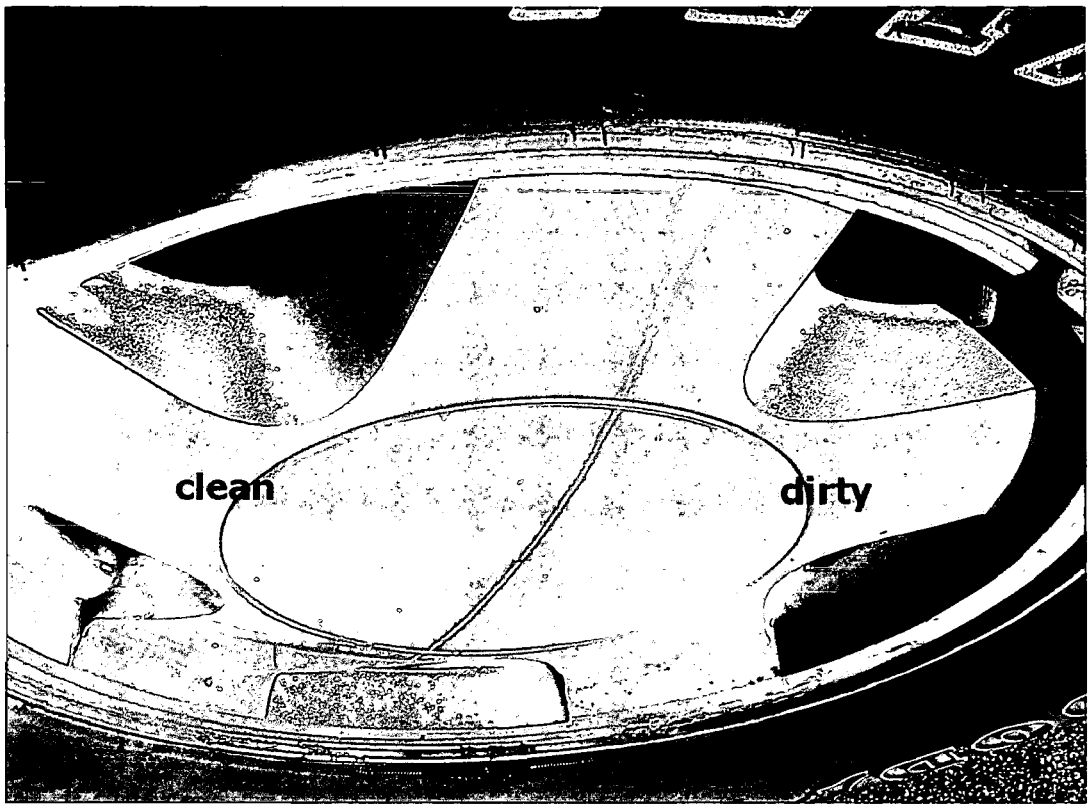
FIG. 4 is a photograph of an automobile wheel after one half has been cleaned with the foam composition of the invention.

Half of an aluminum wheel, on an automobile being driven generally daily, was sprayed with a cleaner foam composition according to the present invention. The results are shown in FIG. 4, which is a photograph of the automobile wheel after one half has been cleaned with the foam composition of the invention and the other half was not cleaned.

The above specification, examples and data provide a complete description of the manufacture and use of the composition of the invention. Since many embodiments of the invention can be made without departing from the spirit and scope of the invention, the invention resides in the claims hereinafter appended.

What is claimed:

1. A cleaning composition comprising:

(a) an acid package comprising a metal bisulfate and an inorganic metal sulfate salt, the inorganic metal sulfate salt being present in an amount sufficient to reduce formation of sulfuric acid when the acid package is in contact with water; the acid package being present in an amount sufficient to provide a brightening affect on a metal surface;

(b) surfactant comprising a nonionic surfactant; and (c) from about 0.1 wt % to about 5 wt % of a foam boosting solvent selected from the group consisting of propylene glycol butyl ether, dipropylene glycol methyl ether, dipropylene glycol propyl ether, ethylene glycol butyl ether, diethylene glycol propyl ether, triethylene glycol methyl ether and propylene glycol methyl ether acetate;

wherein the cleaning composition has a pH of about 1 to about 7.

2. The cleaning composition of claim 1 wherein the acid package comprises a weight ratio of about 10/1 to 1/10 metal bisulfate to inorganic metal sulfate salt.

3. The cleaning composition of claim 1, wherein the inorganic metal sulfate salt comprises sodium sulfate.

4. The cleaning composition of claim 3 wherein the acid package consists of sodium bisulfate and sodium sulfate.

5. The cleaning composition of claim 1, wherein the surfactant further comprises a cationic surfactant.

6. The cleaning composition of claim 5, wherein the cationic surfactant is a quaternary ammonium compound.

7. The cleaning composition of claim 1, wherein the weight ratio of the acid package to the total amount of surfactant is about 1:25 to about 25:1.

8. A foam dispenser comprising:

(a) a container comprising a cleaning composition of claim 1; and (b) a mechanical foaming head comprising:

(i) an air and liquid mixing chamber;

(ii) an air inlet for delivering air to the air and liquid mixing chamber;

(iii) a liquid inlet line for delivering the cleaning composition from the container to the air and liquid mixing chamber; and (iv) an outlet line for delivering a mixture of air and liquid from the air and liquid mixing chamber outside of the mechanical foaming head.

9. The foam dispenser of claim 8, wherein the acid package consists of sodium sulfate and sodium bisulfate.

10. The foam dispenser of claim 8, wherein the surfactant further comprises a cationic surfactant.

11. The foam dispenser of claim 10, wherein the cationic surfactant is a quaternary ammonium compound.

12. The foam dispenser of claim 8, wherein the weight ratio of the acid package to the total amount of surfactant in the cleaning composition is between about 1:25 and about 25:1.

13. The foam dispenser of claim 8, wherein the foaming dispenser head comprises a trigger that is constructed to be actuated by finger pressure.

14. A method for foaming a cleaning composition, method comprising the step of:

(a) mixing the cleaning composition of claim 1 and air in a mechanical foaming head to generate a foam without the use of a non-air containing propellant.

15. The method of claim 14 wherein the inorganic metal sulfate salt is sodium sulfate.

16. The method of claim 14 wherein the acid packages consists of sodium sulfate and sodium bisulfate.

17. A method for cleaning a metal surface, the method comprising the step of:

(a) mixing a cleaning composition claim 1 and air in a mechanical foaming head to generate a foam without the use of a non-air containing propellant; and (b) contacting the metal surface with the resulting foam.

18. The method of claim 17 wherein the acid package consists of sodium bisulfate and sodium sulfate.

19. The method of claim 18, wherein the metal surface comprises aluminum.

20. A cleaning composition comprising:

(a) no more than 20 wt % of an acid package consisting of a 5/1 to 1/5 ratio of metal bisulfate and an inorganic metal sulfate salt;

(b) no more than about 35 wt % of surfactant comprising a nonionic surfactant; and (c) from about 0.1 wt % to about 5 wt % of a foam boosting solvent selected from the group consisting of propylene glycol butyl ether, dipropylene glycol methyl ether, dipropylene glycol propyl ether, ethylene glycol buthyl ether, diethylene glycol propyl wherein the cleaning composition has a pH of about 1 to about 8.

21. The cleaning composition of claim 20 wherein the acid package consists of sodium bisulfate and sodium sulfate.

22. The cleaning composition of claim 21 comprising:

(a) no more than 10 wt % of the acid package; and (b) no more than about 13 wt % of surfactant.

23. The cleaning composition of claim 22 wherein the acid package consists of a 2/1 to 1/2 ratio of sodium bisulfate and sodium sulfate.

* * * * *